US005996469A

United States Patent [19]

Green

[11] Patent Number: 5,996,469

[45] Date of Patent: Dec. 7, 1999

[54] RODLESS POWER CYLINDER

[75] Inventor: Joseph H. Green, Tampa, Fla.

[73] Assignee: Greenco Manufacturing Corporation, Tampa, Fla.

[21] Appl. No.: 09/056,142

[22] Filed: Apr. 7, 1998

[51] Int. Cl.[6] ..... F01B 29/00

[52] U.S. Cl. ..... 92/88; 277/345

[58] Field of Search ..... 92/88; 277/345

[56] References Cited

U.S. PATENT DOCUMENTS

| | | | |
|---|---|---|---|
| 4,373,427 | 2/1983 | Garlapaty et al. | 92/88 |
| 4,545,290 | 10/1985 | Lieberman . | |
| 4,664,020 | 5/1987 | Kaiser | 92/88 |
| 4,724,744 | 2/1988 | Rosengren | 92/88 |
| 4,733,604 | 3/1988 | Lipinski | 92/88 |
| 4,785,716 | 11/1988 | Vaughn et al. . | |
| 4,796,515 | 1/1989 | Dry . | |
| 4,813,341 | 3/1989 | Vaughn . | |
| 4,819,546 | 4/1989 | Ernst et al. | 92/88 X |
| 4,829,881 | 5/1989 | Taki et al. | 92/88 |
| 4,852,465 | 8/1989 | Rosengren | 92/88 |
| 4,991,494 | 2/1991 | Migliori | 92/88 |
| 4,998,459 | 3/1991 | Blatt | 92/88 |
| 5,241,897 | 9/1993 | Drittel | 92/88 |
| 5,245,910 | 9/1993 | Drittel . | |
| 5,317,957 | 6/1994 | Miyamoto | 92/88 |
| 5,517,901 | 5/1996 | Lipinski | 92/88 |
| 5,531,151 | 7/1996 | Matsui | 92/88 |
| 5,778,758 | 7/1998 | Barth et al. | 92/88 |
| B1 4,545,290 | 3/1993 | Lieberman . | |

FOREIGN PATENT DOCUMENTS

| | | | |
|---|---|---|---|
| 6-159326 | 6/1994 | Japan | 92/88 |

*Primary Examiner*—John E. Ryznic

*Attorney, Agent, or Firm*—Gifford, Krass, Groh, Sprinkle, Anderson & Citkowski, P.C.

[57] ABSTRACT

A rodless power cylinder assembly comprising a cylinder having a pair of side walls, at least two bearing grooves being formed in each of the side walls, each bearing groove extending substantially parallel to a bore. Each bearing groove is operative to receive at least a portion of a bearing which engages a trolley assembly. A slot extends outwardly from the bore through the upper surface of the cylinder. Means are provided for sealing the slot during the reciprocal movement of the piston, the means including at least one external groove formed in the upper surface of the cylinder and at least one internal groove formed in the bore of the cylinder, the internal groove being disposed substantially below and in vertical alignment with the external groove. An external seal having at least one downwardly extending ridge is operative to engage the external groove and an internal seal having at least one upwardly extending ridge is operative to engage the internal groove, the internal and external seals thereby sealing the slot during the reciprocal movement of the piston.

11 Claims, 6 Drawing Sheets

RODLESS POWER CYLINDER

FIELD OF THE INVENTION

The present invention relates generally to rodless power cylinders and more particularly to a rodless power cylinder having a piston movable within the cylinder and a trolley assembly connected to the piston for transmitting motion from the piston to the trolley assembly and linear bearings facilitating movement of the trolley assembly and to seals for such rodless power cylinders.

BACKGROUND OF THE INVENTION

Rodless power cylinders utilize fluid pressure to move a piston reciprocally within a longitudinal bore of a cylinder. A longitudinal slot extends along the length of the bore and from the bore through the upper portion of the cylinder. It is important that the slot in the cylinder be sealed during movement of the piston to prevent fluid leakage and to maintain the proper fluid pressures within the cylinder. The movement of the piston within the cylinder is transferred exteriorly of the cylinder by a bracket assembly which is connected at one end to the cylinder and extends through the longitudinal slot in the cylinder. The other end of the bracket is mechanically connected to a trolley assembly which slidably engages the exterior of the cylinder. The trolley assembly stabilizes the movement of the piston within the bore and provides the means for using the movement of the piston to perform work. As the fluid pressure within the bore is varied, the piston moves reciprocally within the cylinder and its motion is transferred, via the bracket, through the slot to the trolley.

Sealing of the slot and the stability of the piston during its reciprocal movement frequently create difficulties which result in inefficiencies in the rodless power cylinder. A variety of solutions have been proposed to maintain an adequate seal of the slot and the stability of the piston during movement.

The slot in the cylinder in prior art rodless cylinders is frequently sealed through an arrangement utilizing two seals. These seals lock either to each other or to the cylinder, one seal being disposed outside the bore and the other seal being disposed within the bore. One configuration where the seals lock to the cylinder is disclosed in U.S. Pat. No. 4,991,494 to Migliori, where a pair of reinforced strips are utilized to seal the outside and the inside of the slot. The strips include ridges which sealingly engage offset grooves formed in the cylinder. The offset placement of the these grooves does not effectively utilize the minimal amount of available space in the upper portion of the cylinder.

It is also important that the trolley assembly stabilizes the piston during its reciprocal movement. While most prior art devices utilize a single linear bearing disposed between each side of the cylinder and the trolley, in many applications this is insufficient to maintain the desired degree of stability. Thus, there remains a need for a rodless power cylinder which includes means for successively sealing the slot during the reciprocal movement of the bracket while effectively utilizing the space of the upper portion of the cylinder and enhancing the stability of the piston during its movement.

SUMMARY OF THE INVENTION

The present invention is a rodless power cylinder comprising a cylinder having a longitudinal axis and a pair of side walls. Each side wall has at least two bearing grooves formed therein. Each bearing groove extends parallel to the longitudinal axis of the cylinder and receives at least a portion of a linear bearing which, in the preferred embodiment, is cylindrical. A bore extends through the cylinder, the bore being parallel to the longitudinal axis of the cylinder. A slot extends parallel to the longitudinal axis of the cylinder, the slot extending outwardly from the bore through an upper surface of the cylinder.

A piston is adapted for reciprocal movement within the bore and is mechanically connected to a bracket. The bracket extends through the slot and is mechanically connected to a trolley assembly. The bracket transfers the reciprocal movement of the piston within the bore exteriorly of the cylinder to the trolley assembly. The trolley assembly is disposed about a portion of the cylinder and slidably engages the bearings disposed between the trolley assembly and the bearing grooves formed in the side walls of the cylinder.

Means for sealing the slot during reciprocal movement of the piston are provided, such means including at least one external groove formed in the upper surface of the cylinder and at least one internal groove formed in the bore of the cylinder. The internal groove is disposed below and in approximate vertical alignment with the external groove, thereby most efficiently utilizing the available space for sealing. An external seal is provided having at least one downwardly extending ridge which engages the external groove. An internal seal is provided having at least one upwardly extending ridge which engages the internal groove. In the preferred embodiment, the external seal has a pair of downwardly extending ridges which engage a pair of external grooves, the external grooves being disposed on opposite sides of the slot. The preferred embodiment also includes an internal seal having a pair of upwardly extending ridges which engage a pair of internal grooves, the internal grooves being disposed on opposite sides of the slot.

Other objects, advantages and applications of the present invention will be made clear upon reference to the following detailed description of a preferred embodiment of the invention. The description refers to the following drawings in which:

DETAILED DESCRIPTION OF THE PREFERRED EMBODIMENT

The present invention relates to a rodless power cylinder. As the construction and function of such rodless cylinders are widely known and understood by those skilled in the art, only a brief description of the basic assembly will be provided herein.

Figure 1:
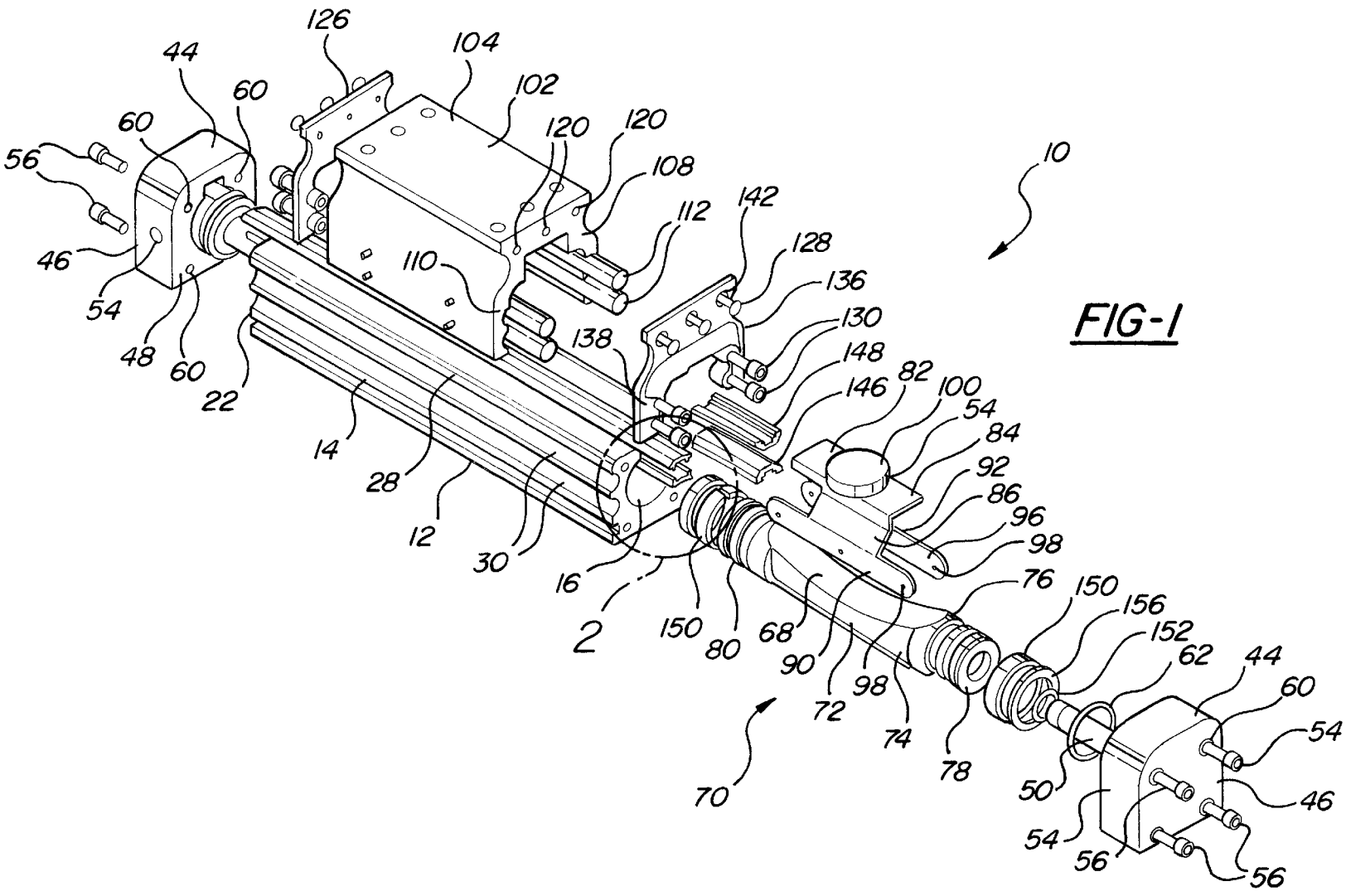
FIG. 1 is an exploded view of the rodless power cylinder of the present invention.
Figure 2:
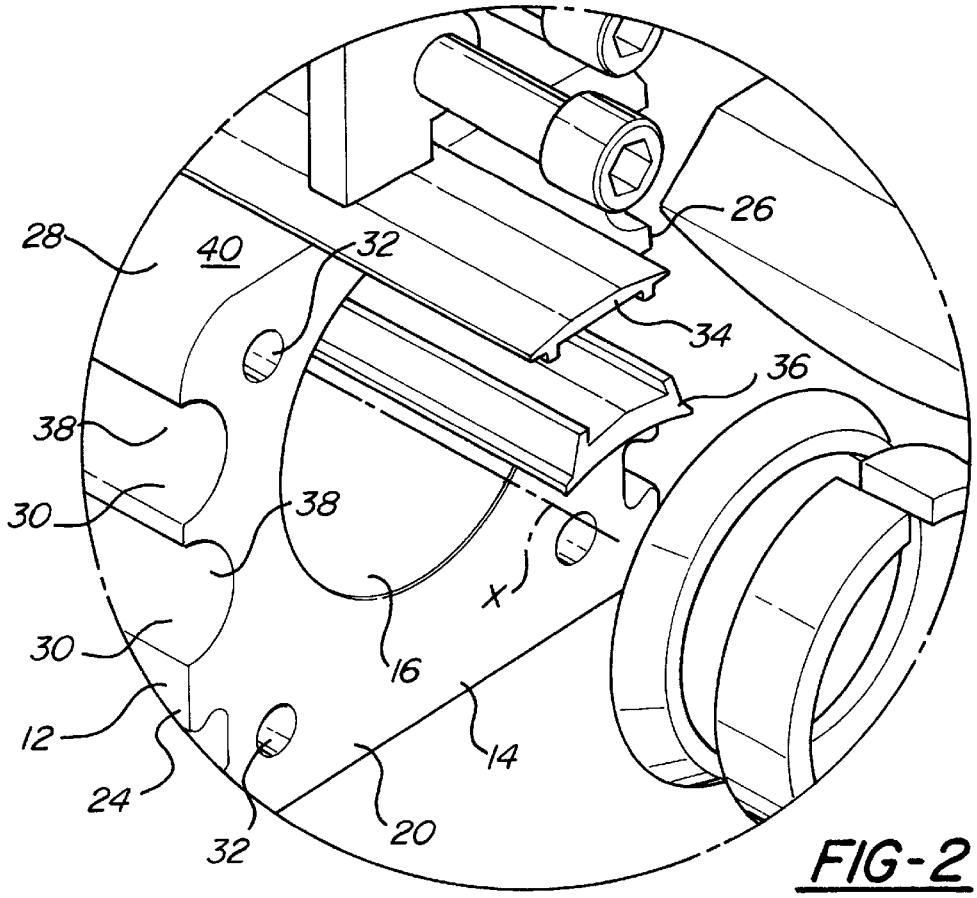
FIG. 2 is an enlarged view of the encircled area in FIG. 1.

As can best be seen in FIG. 1, the main components of a rodless power cylinder include an elongated cylinder 14, a piston assembly 70 and a trolley assembly 104. The cylinder 14 includes an elongated bore 16 which extends the length of the cylinder 14. A slot 18 extends from the bore 16 through the upper surface 28 of the cylinder 14, the slot 18 extending the length of the cylinder 14. A piston assembly 70 is disposed within the bore 16, the piston assembly 70 including a piston 68 and a bracket 82 which is mechanically connected to the piston 68. The bracket 82 extends through the slot 18 and is mechanically connected to a trolley assembly 102 which slidably engages at least a portion of the exterior of the cylinder 14. As the piston assembly 70 moves reciprocally within the cylinder 14 due to the build up and release of fluid pressure at the ends of the piston 68, the bracket 82 transfers the motion of the piston 68 out of the cylinder 14 through the slot 18. The trolley assembly 102 stabilizes the movement of the piston 68 within the cylinder 14. Elongated flexible seals 34 and 36 seal the slot 18 during the reciprocal movement of the piston 68 and bracket 82.

Still referring to FIG. 1, the cylinder 14 of the present invention includes spaced apart elongated side walls 24 and 26 and spaced apart ends 20 and 22. The cylindrical bore 16 extends through the entire length of the elongated cylinder 14. The longitudinal axis X of the cylindrical bore 16 is parallel to the longitudinal axis of the cylinder 14. The elongated slot 18 is formed in the upper portion of the cylinder 14, and extends from the bore 16 through the upper surface 40 of the cylinder 14.

Figure 6:
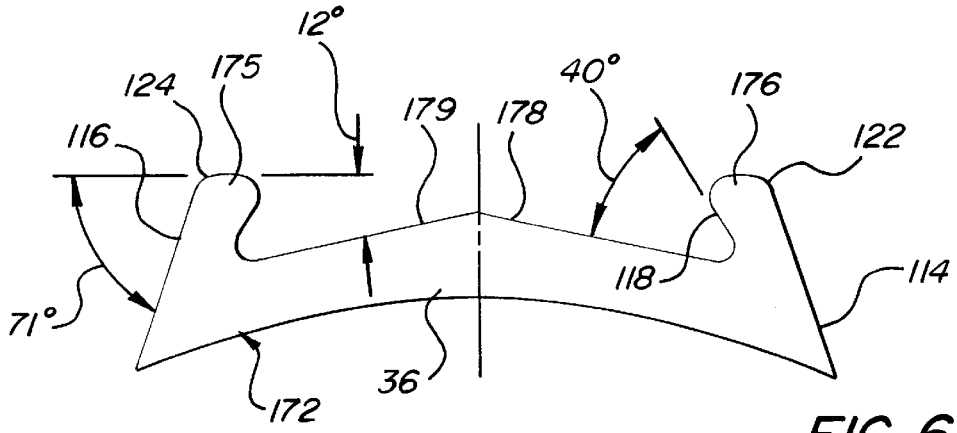
FIG. 6 is an end view of the internal seal.

The present invention utilizes an external seal 34 and an internal seal 36, best shown in FIGS. 2, 3, 6 and 7, to seal the elongated slot 18. As shown in FIG. 6, the internal seal 36 includes a pair of upwardly extending ridges 175 and 176. As each upwardly extending ridge 175, 176 is preferably a mirror image of the other ridge, only one ridge will be described in detail. The ridge 175 includes a side surface 116, a top surface 124 and an interior surface 121. In the preferred embodiment, the side surface 116 is disposed at an angle less than 90° with respect to the top surface 124, and preferably is approximately 70°. The upper surfaces 178 and 179 of the interior seal 36 are also angled with respect to the top surface 124 and, in the preferred embodiment, the upper surface 179 is angled between 10 and 15° with respect to the top surface 124. Preferably, the upper surface 179 is disposed at an angle of 12° with respect to the top surface 124. The Inner surface 121 of the upwardly extending ridge 175 is angled with respect to the upper surface 179 and, in the preferred embodiment, the inner surface 121 is disposed at an angle of less than 50° with respect to the upper surface 179. Preferably, the angle between the upper surface 179 and the inner surface 121 is approximately 45°.

Figure 4:
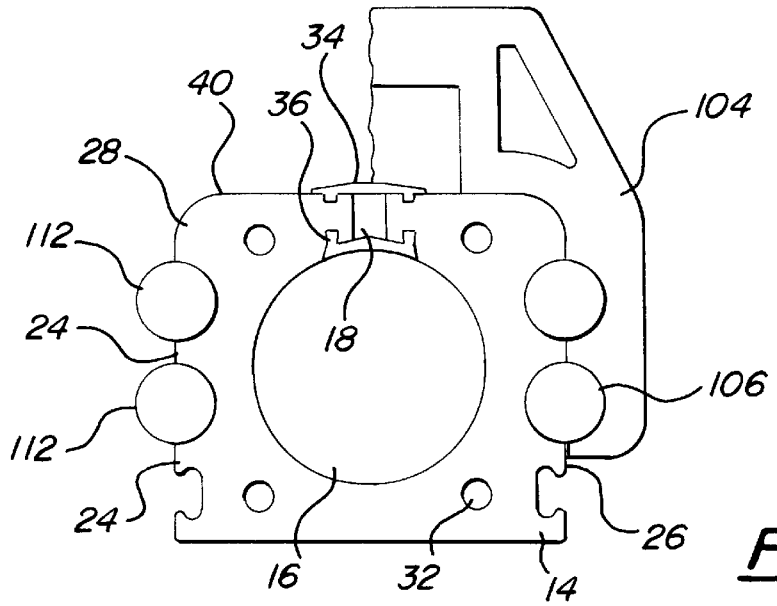
FIG. 4 is a partial cross-sectional view of a rodless power cylinder showing the cylinder, the seals, the linear bearings and the trolley.

As shown in FIG. 4, the internal seal 36 engages the upper portion of the cylinder 14. This upper portion of the cylinder 14 is shown in more detail in FIG. 5. The upwardly extending ridges 175 and 176 of the interior seal 36 engage internal grooves 162 and 168 which are formed at the upper portion of the bore 16. When the interior seal 36 is mated to the internal grooves 162 and 168, the upper surfaces 178 and 179 of the seal 36 engage lower surfaces 160 and 166.

Figure 5:
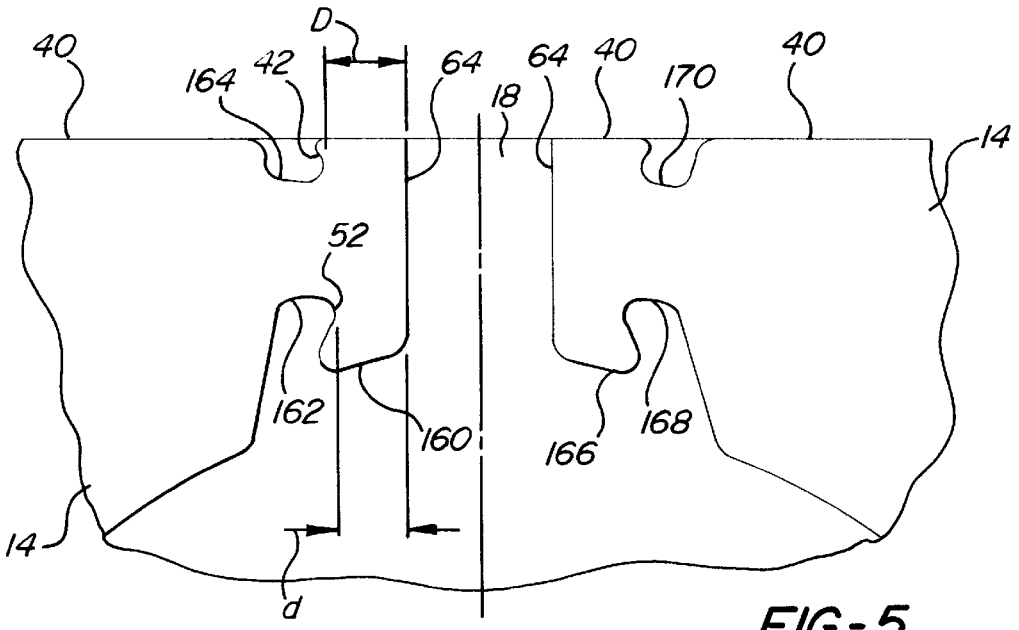
FIG. 5 is an end view of the upper portion of the cylinder.

As shown in FIG. 5, the upper surface 40 of the cylinder 14 preferably includes at least one external groove 164 and, in the preferred embodiment, includes two external grooves 164 and 170. Preferably, one external groove 164, 170 and one internal groove 162, 168 are disposed on each side of the slot 18. As is clearly shown in FIGS. 4 and 5, each internal groove 162, 168 is disposed below and in approximate vertical alignment with each external groove, 164, 170 thus efficiently utilizing the space available along the upper portion of the cylinder 14. It is not necessary that the particular configurations of the external groove 164, 170 mimic the configuration of the internal groove, 162, 168, but merely that they are disposed relative to one another so as to effectively utilize the upper portion of the cylinder 14 by reducing the area required for sealing.

Figure 7:
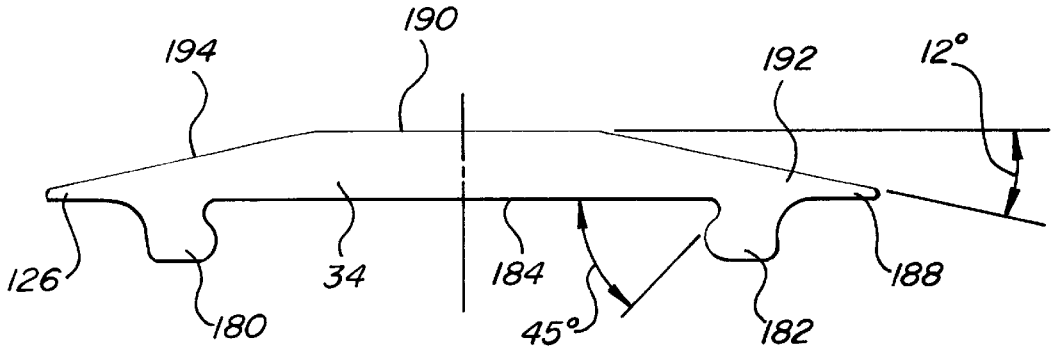
FIG. 7 is an end view of the external seal.

The external seal 34 is best shown in FIG. 7 as including two downwardly extending ridges 180 and 182 which are configured to engage the external grooves 164 and 170. The ridges 180 and 182 are preferably mirror images of each other. The lower surface 184 of the external seal 34 is substantially flat and engages the upper surface 40 between the external grooves 164 and 170. Edges 186 and 188 extend beyond the ridges 180 and 182 to enhance the ability of the external seal 34 to seal the slot 18. Preferably, the external seal 34 is thicker in its midsection between lower surface 184 and upper surface 190 to provide rigidity and stability to the seal. The surfaces 194 and 192 are preferably angled with respect to the upper surface 190 and the lower surface 184 to reduce the thickness of the outer portions of the seal proximate the ridges 180 and 182. This configuration increases the flexibility of the seal proximate the ridges 180, 182 and enhances the ability of the ridges 180, 182 to engage and disengage the external grooves 164 and 170.

In a preferred embodiment shown in FIG. 5, an inner edge 42 of the external groove 164 is preferably spaced apart from the slot surface 64 by a distance D, preferably ranging between 0.11 and 0.13 millimeters. Preferably the inner edge 42 is spaced apart from the slot surface 64 by a distance of 0.12 millimeters. In the preferred configuration, the inner edge 52 of the internal groove 162 is preferably spaced apart from the slot surface 64 by a distance d which ranges between 0.19 and 0.21 millimeters. Most preferably, the inner edge 52 is spaced apart from the slot surface 64 by a distance d equal to 0.2 millimeters. Although only one pair of internal and external grooves have been described in detail, the preferred configuration is applicable to both sets of grooves.

FIG. 4 depicts the external seal 34 and internal seal 36 in engagement with the cylinder 14, thereby sealing the slot 18.

Referring again to FIG. 1, a head assembly 44 is mechanically connected to each end 20 and 22 of the cylinder 14 to seal the bore 16. The head assemblies 44 may be connected to the cylinder 14 in any conventional way. In the preferred embodiment, four head bolts 56 pass through head apertures 60 formed in the head 46 and engage the apertures 32 in the ends 20, 22 of the cylinder. A boss 50 extends inwardly from the head assembly 44 within the bore 16.

A piston assembly 70 is disposed within the cylindrical bore 16 between the head assemblies 44. The piston assembly 70 includes the elongated piston 68 having a central portion 72 disposed between ends 78 and 80. The piston 68 also includes bracket mating surfaces 74 and 76 disposed on opposite sides of the piston 68 along the central portion 72. Disposed between the piston ends 78 and 80 and the head assemblies 44 are a wear band 150, a cushion seal 152 and a head O ring 62, as well as a piston U-cup 156. Each head assembly 44 also includes a fluid passage 54 whereby fluid may be introduced and evacuated from the cylindrical bore 16 at each piston end 78 and 80, thereby allowing the fluid pressure at the piston ends to be altered. As the fluid pressure at the ends 78 and 80 is varied, the piston 68 is moved reciprocally within the cylinder bore 16.

Figure 3:
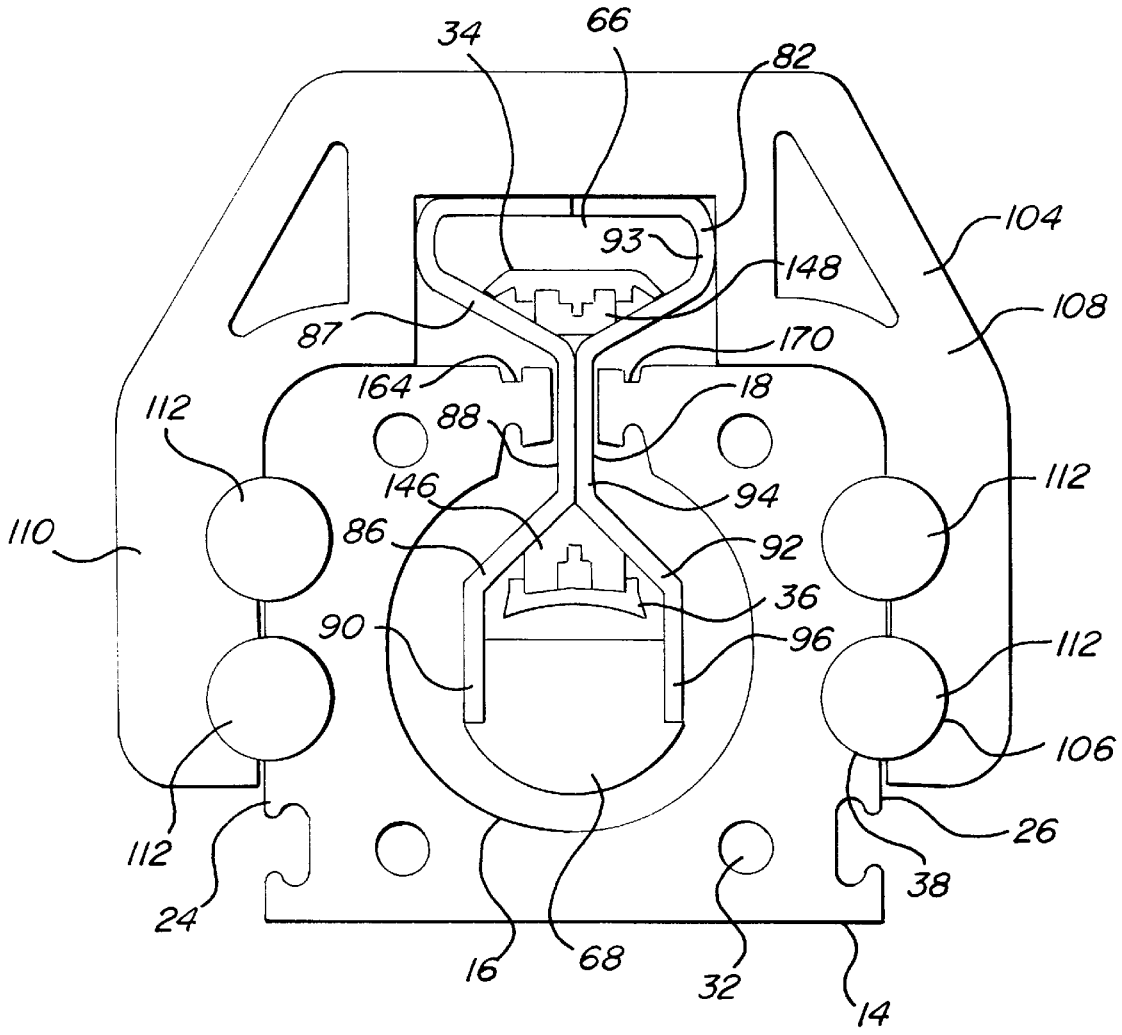
FIG. 3 is a partial cross-sectional view of a rodless power cylinder.

A bracket 82, best shown in FIGS. 1 and 3, includes two bracket arms 86 and 92 each having lower, spaced apart portions 90 and 96, respectively, and upper portions 87 and 93, respectively. The upper portions 87 and 93 form an enclosure 66. Disposed between each upper and lower, spaced apart portions of the bracket arms 86 and 92 are midportions 88 and 94, respectively, the midportions 88, 94 being sufficiently close to each other so that they are able to pass through the slot 18 without contacting the side surfaces 64. The lower portions 90 and 96 of bracket arms 86 and 92 are mechanically connected via apertures 98 to the bracket mating surfaces 74 and 76, respectively. The bracket mating surfaces 74 and 76 are recessed so that the piston may move within the cylindrical bore 16 without engaging the sides of the bore 16.

As shown in FIGS. 1 and 3, the trolley assembly 102 includes a trolley 104 having arms 108 and 110 which extend downwardly from a central portion 118. A trolley end plate 126 is attached to each end of the trolley 104 via threaded members 128 which are received in apertures 120. The trolley arms 108 and 110 are configured to engage linear bearings 112. To enhance the stabilization of the trolley assembly 102 and piston assembly 70 as the piston 68 moves within the bore 16, at least two linear bearings 112 are utilized on each trolley arm 108, 110.

The bracket top 84 is configured to loosely engage a trolley pin 100 which connects the trolley 104 to the bracket 82 so that the motion of the piston 68 is transferred to the trolley assembly 102.

FIG. 3 shows the positions of the seals 34 and 36 as the bracket 82 and the piston 68 move through the bore 16 and the slot 18. As shown in partial cross section therein, the bracket 82 is connected at its lower portion to the piston 68 at its central portion 72. A lower seal guide 146 is positioned between the bracket arms 86 and 92 and contacts the upper surfaces 178 and 179 of the interior seal, thus moving it out of engagement with the internal grooves 162 and 168. Likewise, an upper seal guide 148 is disposed within the opening 66 of the bracket 82. The upper seal guide 148 engages the lower surface 184 of the external seal 34 to move the ridges 180 and 182 out of engagement with the external grooves 164 and 170.

Figure 8A:
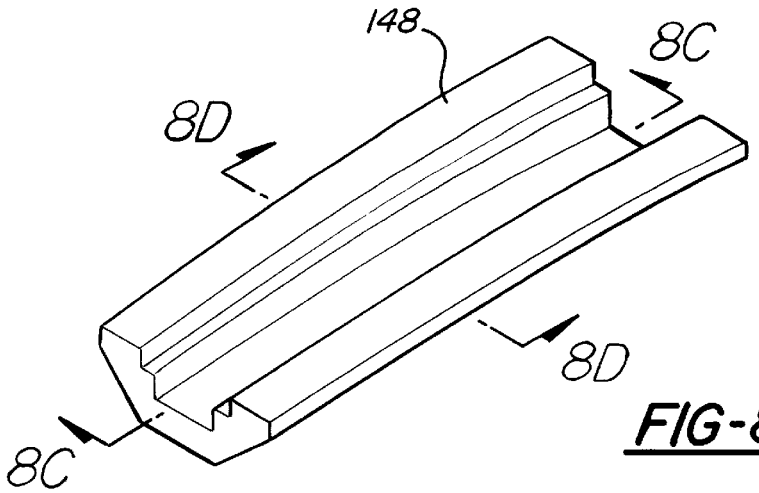
FIGS. 8A through 8D are views of the top band guide.
Figure 8C:
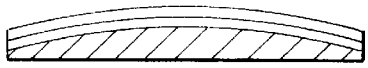
Figure 8B:
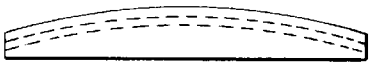
Figure 8D:
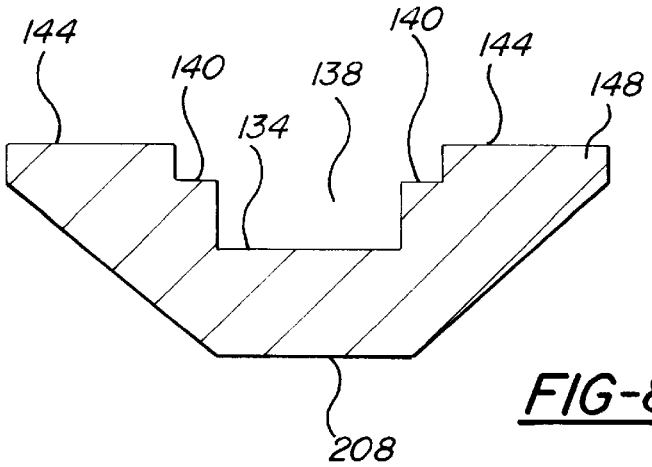

FIGS. 8A–D and 9A–E show the particular configurations of the lower seal guide 146 and upper seal guide 148. Each seal guide is configured to move the seal into and out of engagement with the grooves formed in the cylinder. In the preferred embodiment shown in cross-section in FIG. 8D, the upper seal guide 148 has a V-shaped cross-section and includes a lower surface 132 and an upper surface 144. A channel 133 is formed in the upper surface 144, the channel 133 being formed by a lower surface 134 and stepped surfaces 140. FIG. 8A shows a perspective view of the preferred embodiment of upper seal guide 148. FIG. 8B shows a side view of the upper seal guide 148, and FIG. 8C shows a partial cross-sectional view taken along lines 8C—8C of FIG. 8A. As clearly shown in the drawings, the upper seal guide 148 is arched to guide the external seal 34 into and out of engagement with the external grooves 164 and 170.

Figure 9A:
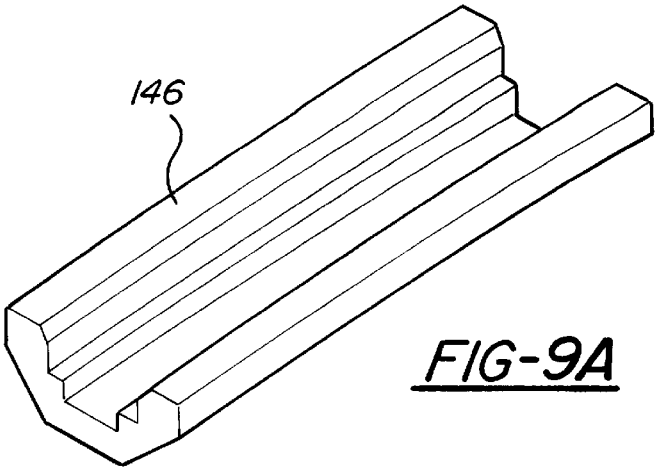
FIGS. 9A through 9E are views of the bottom band guide.
Figure 9B:
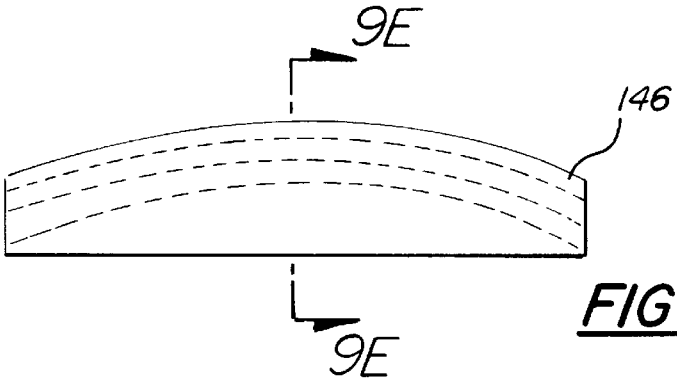
Figure 9C:
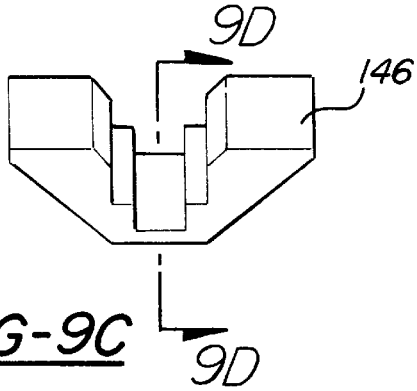
Figure 9D:
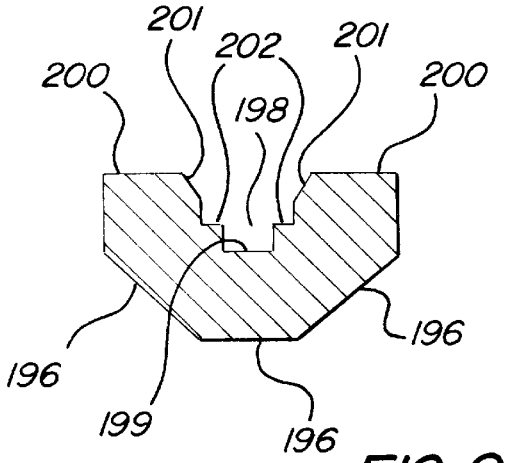
Figure 9E:
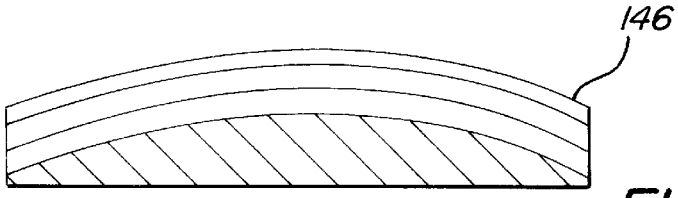

The preferred embodiment of the lower seal guide 146 is shown in FIGS. 9A–9E. A perspective view of the lower seal guide is shown in FIG. 9A and a side view is shown in FIG. 9B. A cross-sectional view of the lower seal guide 146, taken along line E—E in FIG. 9B, is shown in FIG. 9E. The lower seal guide 146 comprises a lower surface 196 and an upper surface 200. A channel 198 is formed in the upper surface 200, the channel 198 being formed by a lower surface 199, stepped surfaces 202 and angled surfaces 201. The lower seal guide 146 is arched to assist the removal from and the engagement of the internal seal 36 with the internal grooves 162 and 168.

As shown in FIGS. 1–4, at least two bearing grooves 30 are formed in the side walls 24 and 26 of the cylinder 14. The bearing grooves 30 extend the length of the cylinder 14. The linear bearings 112 engage bearing surfaces 38 of the bearing grooves 30. In this manner, the trolley 104 slidably engages the cylinder 14, thus enabling the trolley assembly 102 to reciprocate along the cylinder 14. Bearing retaining screws 130 hold the bearings 112 in place.

Having described the various embodiments of the present invention with reference to the accompanying figures, it will be appreciated that various changes and modifications can be made without departing from the scope or spirit of the invention.

I claim:

1. A cylinder comprising:

two spaced apart side walls;

two spaced apart ends;

a bore extending between the spaced apart ends;

at least two bearing grooves formed in at least one of the side walls, each bearing groove extending substantially parallel to the bore and operative to receive at least a portion of a bearing;

an upper surface;

an elongated slot extending outwardly from the bore through the upper surface of the cylinder;

at least one external groove formed in the upper surface of the cylinder; and at least one internal groove formed in the bore of the cylinder, the internal groove being disposed substantially below and in vertical alignment with the external groove, wherein each of the grooves is formed by an inner edge that is not part of the slot.

2. The cylinder of claim 1 comprising two external grooves and two internal grooves.

3. The cylinder of claim 1 wherein the bearing grooves have a radius ranging between 0.25 and 0.27 mm.

4. The cylinder of claim 3 wherein the bearing grooves have a radius ranging between 0.255 and 0.265.

5. The cylinder of claim 4 wherein the bearing grooves have a radius of 0.26.

6. The cylinder of claim 1 wherein an inner edge of the external groove is spaced apart from a slot surface by a distance ranging between 0.11 and 0.13 mm.

7. The cylinder of claim 6 wherein an inner edge of the internal groove is spaced apart from a slot surface by a distance ranging between 0.19 and 0.21 mm.

8. The cylinder of claim 6 wherein the inner edge of the external groove is spaced apart from the slot surface by a distance of 0.12 mm.

9. The cylinder of claim 8 wherein the inner edge of the internal groove is spaced apart from the slot surface by a distance of 0.2 mm.

10. A rodless power cylinder comprising:

a cylinder having two spaced apart side walls, two spaced apart ends, a bore extending between the spaced apart ends, at least two bearing grooves formed in at least one of the side walls, each bearing groove extending substantially parallel to the bore and operative to receive at least a portion of a bearing, an upper surface, an elongated slot extending outwardly from the bore through the upper surface of the cylinder, at least one external groove formed in the upper surface of the cylinder, and at least one internal groove formed in the bore of the cylinder, the internal groove being disposed substantially below and in vertical alignment with the external groove, wherein each of the grooves is formed by an inner edge that is not part of the slot;

a piston adapted for reciprocal movement within the bore;

an internal seal operative to engage the internal groove and seal the slot;

an external seal operative to engage the external groove and seal the slot; and means for transferring the reciprocal motion of the piston outside said cylinder.

11. A rodless power cylinder assembly comprising:

a cylinder having a longitudinal axis, a pair of side walls, each side wall having two bearing grooves, each bearing groove extending substantially parallel to the longitudinal axis of the cylinder and operative to receive at least a portion of a bearing;

a bore extending through the cylinder and substantially parallel to the longitudinal axis of the cylinder, an upper surface;

a slot extending substantially parallel to the longitudinal axis of the cylinder, the slot extending outwardly from the bore through the upper surface of the cylinder;

a piston adapted for reciprocal movement within the bore;

a trolley assembly slidably engaging the bearings, the bearings being disposed between the trolley assembly and the bearing grooves of the cylinder, a bracket connected to the piston and the trolley assembly, the bracket extending through the slot and operative to transfer the reciprocal movement of the piston within the bore exteriorly of the cylinder to the trolley assembly;

at least one external groove formed in the upper surface of the cylinder;

at least one internal groove formed in the bore of the cylinder, the internal groove being disposed substantially below and in vertical alignment with the external groove, wherein each of the grooves is formed by an inner edge that is not part of the slot;

an external seal having at least one downwardly extending ridge operative to engage the external groove; and an internal seal having at least one upwardly extending ridge operative to engage the internal groove.

* * * * *